US009534332B2

(12) United States Patent
Gasparini et al.

(10) Patent No.: US 9,534,332 B2
(45) Date of Patent: Jan. 3, 2017

(54) WATER BEARING HOUSEHOLD APPLIANCE AND ASSOCIATED OPERATING METHOD

(71) Applicant: Electrolux Home Products Corporation N.V., Brussels (BE)

(72) Inventors: Mirko Gasparini, Spilimbergo (IT); Paolo Driussi, Zoppola (IT); Paolo Quattrin, Porcia (IT); Thomas Hoppichler, Porcia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 130 days.

(21) Appl. No.: 14/406,372

(22) PCT Filed: Jun. 6, 2013

(86) PCT No.: PCT/EP2013/061662
§ 371 (c)(1),
(2) Date: Dec. 8, 2014

(87) PCT Pub. No.: WO2013/182630
PCT Pub. Date: Dec. 12, 2013

(65) Prior Publication Data

US 2015/0152584 A1 Jun. 4, 2015

(30) Foreign Application Priority Data

Jun. 8, 2012 (EP) ..... 12171244

(51) Int. Cl.

| | |
|---|---|
| ***D06F 33/02*** | (2006.01) |
| ***D06F 39/02*** | (2006.01) |
| ***A47L 15/44*** | (2006.01) |
| ***D06F 39/00*** | (2006.01) |

(52) U.S. Cl.
CPC ..... *D06F 33/02* (2013.01); *A47L 15/449* (2013.01); *D06F 39/003* (2013.01); *D06F 39/02* (2013.01);
(Continued)

(58) Field of Classification Search
CPC ..... D06F 33/02; D06F 39/003; D06F 39/02; D06F 2204/02; A47L 15/449; A47L 2301/04; A47L 2401/023; A47L 2401/04; A47L 2501/07
See application file for complete search history.

(56) References Cited

U.S. PATENT DOCUMENTS

2010/0000022 A1* 1/2010 Hendrickson ..... D06F 39/02 8/137
2010/0000023 A1* 1/2010 McAllister ..... A47L 15/0055 8/137
(Continued)

FOREIGN PATENT DOCUMENTS

CN 101307549 A 11/2008
CN 101397736 A 4/2009
(Continued)

OTHER PUBLICATIONS

International Search Report dated Nov. 18, 2013 issued in corresponding International Application No. PCT/EP2013/061662.
(Continued)

*Primary Examiner* — Joseph L Perrin
(74) *Attorney, Agent, or Firm* — Banner & Witcoff, Ltd.

(57) ABSTRACT

A water bearing household appliance (1) includes: a treating chamber (6) in which one or more items (7) can be loaded and treated with water and one or more additives; a logic unit (12) to control the electric and/or electronic components of the appliance (1) so as to make the latter to perform a
(Continued)

treating cycle for treating the one or more loaded items (7) with water and one or more additives; a load amount acquiring device (13) for acquiring and communicating to the logic unit (12) information related to the amount of the one or more items (7) loaded in the treating chamber (6); and a user interface (14) configured for allowing a user to set parameters related to the treating cycle and to the one or more additives to be used during the treating cycle. The logic unit (12) is configured to: store, during a programming state, additive information set by the user via the user interface (14), the additive information comprising one or more numeric values which are indicative of predetermined maximum amount of additive associated with the maximum loading capacity of the treating chamber; before the appliance (1) starts a selected treating cycle, determine an amount of a selected additive to be loaded for this selected treating cycle, based on the programmed maximum amount of additive associated with the selected additive, on the acquired amount of the one or more items (7) loaded in the treating chamber (6), and on the selected treating cycle; and provide the user with information related to the determined amount of additive to be loaded via the user interface (14).

15 Claims, 6 Drawing Sheets

(52) U.S. Cl.
CPC ..... *A47L 2301/04* (2013.01); *A47L 2401/023* (2013.01); *A47L 2401/04* (2013.01); *A47L 2501/07* (2013.01)

(56) References Cited

U.S. PATENT DOCUMENTS

| | | | | |
|---|---|---|---|---|
| 2010/0000573 | A1* | 1/2010 | Hendrickson | D06F 33/02 134/18 |
| 2010/0186460 | A1 | 7/2010 | Boldt et al. | |
| 2011/0030729 | A1* | 2/2011 | Gnadinger | A47L 15/0021 134/18 |
| 2013/0042416 | A1* | 2/2013 | Balinski | D06F 39/002 8/137 |
| 2013/0086754 | A1* | 4/2013 | Hendrickson | D06F 39/003 8/137 |
| 2014/0326067 | A1* | 11/2014 | Chanda | G01N 9/00 73/32 R |
| 2014/0352077 | A1* | 12/2014 | Leitert | D06F 39/003 8/137 |
| 2014/0352078 | A1* | 12/2014 | Leitert | D06F 39/003 8/137 |

FOREIGN PATENT DOCUMENTS

| | | |
|---|---|---|
| DE | 102009029443 A1 | 3/2011 |
| JP | 06-233894 | 8/1994 |

OTHER PUBLICATIONS

English translation of Office Action dated Mar. 2, 2016, and Search Report dated Feb. 17, 2016, in mrresponding Chinese Application No. 201380030113.X.

* cited by examiner

WATER BEARING HOUSEHOLD APPLIANCE AND ASSOCIATED OPERATING METHOD

BACKGROUND

The present invention concerns a water bearing household appliance, for example a laundry washing machine or a dishwasher, and a method for operating this appliance.

Nowadays it is known using water bearing household appliances, for example laundry washing machines and dishwashers, in which one or more items (e.g. pieces of laundry or dishware) can be loaded and treated (e.g. washed) with water and one or more additives (e.g. washing/rinsing products).

The dosage or the additive is always a tricky issue, since a too low amount of additive could compromise the washing effectiveness, while a too high amount of additive has the problem that some additive can settle on the washed items and remain on the latter even after unloading them from the appliance, and/or can be a source of pollution.

The correct amount of additives is related to the specific treating cycle (e.g. washing cycle), and to the amount (or quantity, or weight) of loaded items.

There is therefore the need to know the exact amount of additive which has to be provided to the appliance in relation to the selected treating cycle and to the amount of loaded items.

As stated above, a water bearing household appliance could be, for example, a laundry washing machine or a dishwasher.

It is underlined that in the present application the expression "laundry washing machine" will refer to both simple laundry washing machines (i.e. laundry washing machines which can only wash and rinse laundry) and laundry washing-drying machines (i.e. laundry washing machines which can also dry laundry).

Known laundry washing machines generally comprise an external casing provided with a washing tub which contains a rotatable perforated drum where the laundry (in this case the items to be washed) is placed.

The drum is rotated by an electric motor which may be connected to a rotating shaft of the drum by a belt pulley system, or may be a so called "direct drive motor", that is a motor fixed to the washing tub and directly connected to the rotating shaft of the drum.

A loading/unloading door ensures access to the tub and the drum.

Laundry washing machines typically comprise a detergent supply unit and a water inlet circuit for the introduction of water and additives, in this case washing/rinsing products (i.e. detergent, softener, etc.) into the tub. Known laundry washing machines are also provided with water draining devices to drain the water from the tub.

According to the known technique, a complete washing cycle typically includes different phases during which the laundry to be washed is subjected to adequate treatments. A washing cycle usually comprises a laundry wetting phase with addition of a washing products. i.e. detergent, and a main washing phase during which, according to the washing program selected by the user, the water contained in the tub is heated to a predetermined temperature and the drum is rotated, so as to apply a mechanical cleaning action to the laundry. After the main washing phase the water contained in the drum is drained from the tub. A successive step of the cycle comprises a rinsing phase which usually comprises one or more rinsing cycles. In each rinsing cycle, clean rinse water is added to the laundry, the drum is rotated, and the water is then drained from the tub to the outside of the washing machine. After the rinsing phase a final spinning phase allows the extraction of the residual water contained in the wet laundry. In the spinning phase the drum is rotated, typically at a high rotation speed to obtain the extraction of the water from the laundry. The water extracted during the spinning phase is drained towards the outside by means of the water draining devices.

Some known washing machines are also provided with a weight measuring device configured to measure the weight of the laundry which is loaded in the washing drum, and with a logic unit, which is configured to determine the necessary amount of washing product to be used on the basis of the measured weight, and to display by the user interface the amount of detergent to be load on the detergent supply unit.

For example, JP 6233894 discloses a washing machine which is provided with a control panel comprising key switch operating as input means for allowing user to manually input the type of washing product, namely the detergent to be used "concentrate" "standard" and "liquid", and setting the water surface level. The washing machine is further provided with a microcomputer, which is configured to: detect the amount of loaded laundry, set the water surface level based on the detected amount of loaded laundry, and determine the amount of washing product to be used, on the basis of the selected washing product, the set water surface level and the amount of loaded laundry. The microcomputer is further configured to display the determined amount of washing product by a common display window arranged in the control panel.

However this known washing machine is not able to determine the correct amount of washing product to be used in the washing cycle when the kind of washing product selected by the user is not stored in the microcomputer. Moreover, detergent-producers often modify features of washing products i.e. amount of washing product to be used for kilo of laundry during determined washing programs. In this case, microcomputer of the washing machine (disclosed in JP 6233894) may determine amount of detergent based on incorrect data, and consequently displays incorrect information about amount of washing product to be used.

US 2010/0186460 A1 discloses a washing machine which operates using a method for adding solid or liquid detergent active ingredients in portions and comprises an electronic programme control unit in addition to devices for entering and/or determining information concerning the desired or required composition of a treatment programme, for determining and/or entering washing-related parameters, i.e. the type of washing introduced into the washing machine, the degree of soiling and/or the weight of said washing. Information concerning the detergent active ingredients and the washing is read in from automatically readable information carriers by means of a read device and the programme control unit calculates and issues recommendations for the addition of a particular type of a detergent active ingredient and the amount of said ingredient in conjunction with this information, the chosen treatment programme and the washing-related parameters. In detail, the washing machine comprises a read device which recognizes transponders, i.e. RFID, tags. Such a read device recognizes washing items provided with transponders, i.e. packaging of a detergent active ingredient containing information concerning the accompanying detergent active ingredient. Instead of a read device and in the case of a washing machine is connected to a data network by means of a data network interface, the data can also be read in at any other point in the data network or be output from there back to the control unit of the washing machine.

Unfortunately, using the read device and/or data network interface in the washing machine, as disclosed in US 2010/0186460, causes the complexity and cost of the machine to increase. In addition, washing machine having read device disclosed in US 2010/0186460 holds users to use detergent packaging provided with transponders.

SUMMARY OF SELECTED INVENTIVE ASPECTS

An aim of the present invention is therefore obtaining a water bearing household appliance, for example a washing machine or a dishwasher, which, on the one hand, is able to inform user about the right amount of any kind of additive to be used in a treating cycle, i.e. without any limitation on the kind of used additive, and on the other hand, does not require any additional complex and/or expensive devices such as data network interfaces or read devices.

It is therefore an object of aspects of the present invention to solve the above-noted problems, thereby doing away with the drawbacks of the cited prior art.

The Applicant has found that by using a water bearing household appliance configured to be programmed by the user for storing information related to the maximum prefixed amounts of additive associated with the maximum load capacity of the appliance, for example according to recommended values provided by the additive producer, it is possible to provide the user, before starting a treating cycle (e.g. a washing cycle), with information about the right amount of additive to be used for treating the actual amount of loaded item/s in a selected treating cycle, without needing online web updating or read devices or other complex solution.

The above-mentioned aim and objects, as well as others that will become better apparent hereinafter, may be achieved by a water bearing household appliance comprising:

- a treating chamber in which one or more items can be loaded and treated with water and one or more additives;
- a logic unit to control the electric and/or electronic components of the appliance so as to make the latter to perform a treating cycle for treating the one or more loaded items with water and one or more additives;
- a load amount acquiring device for acquiring and communicating to the logic unit information related to the amount of the one or more items loaded in the treating chamber;
- a user interface configured for allowing a user to set parameters related to the treating cycle and to the one or more additives to be used during the treating cycle.

In an aspect, the logic unit is configured to:

- store, during a programming state, additive information set by the user via the user interface, the additive information comprising one or more numeric values which are indicative of predetermined maximum amount of additive associated with the maximum loading capacity of the treating chamber,
- before the appliance starts a selected treating cycle, determine an amount of a selected additive to be loaded for this selected treating cycle, based on the programmed maximum amount of additive associated with the selected additive, on the acquired amount of the one or more items loaded in the treating chamber, and on the selected treating cycle,
- provide the user with information related to the determined amount of additive to be loaded via the user interface.

Preferably, the predetermined maximum amount of additive, which user sets during the programming state, is associated with a numeric value recommended/calculated by the producer of the additive.

More preferably, the additive comprises a liquid detergent, and/or a concentrate detergent, and/or powder detergent, and/or a gel detergent and/or a tablet detergent and/or a softener.

Advantageously, the logic unit is configured to display via the user interface a numeric value in grams or milliliters, which is indicative of the determined amount of additive.

Advantageously, the user interface is configured to allow the user, during the programming state, to select/set the additive to be programmed and to regulate the numeric value associated with the predetermined maximum amount of the selected/set additive associated with the maximum load-capacity of the treating chamber.

Preferably, the programming state is performed when the water bearing household appliance is in a rest operating state.

Advantageously, the logic unit is configured to determine an amount of the selected additive to be loaded for the selected treating cycle, based on the programmed maximum amount of additive associated with a selected additive, on the acquired amount of the one or more items loaded in the treating chamber, and on the selected treating cycle, and to provide the user with information related to the determined amount of additive via the user interface, during the loading of the one or more items into the treating chamber. In this way user can receive an indication of the required amount of additive already during the loading of the appliance, which increase the convenience of the appliance.

Advantageously, the load amount acquiring device is configured for detecting the amount of the one or more items loaded in the treating chamber and/or it is configured for allowing a user to set a parameter related to the amount of the one or more items loaded in the treating chamber; for example user may input a numeric value related to the weight/quantity of loaded item (for example the weight of the loaded laundry if the appliance is a washing machine) and/or may set an half-load cycle, i.e. he may input into the machine (for example by a suitable half-load button or switch) the information that he loaded only half of the maximum allowed items.

In other words, the load amount acquiring device may a device (for example a weight sensor), configured for automatically acquiring (i.e. detecting or calculating) the load amount (e.g. the weight of the loaded items), and or it may be a device (for example a "half-load" button, or a switch, or a keyboard or a touchscreen) allowing the user to input a parameter (or information) related to the load amount (for example this parameter may be a numeric value related to the weight of the load, or the information that the amount of loaded items is half of the maximum allowed amount).

In a preferred embodiment of the inventive water bearing household appliance:

- the water bearing household appliance is a laundry washing machine comprising a washing tub containing a rotatable drum adapted for receiving laundry to be washed;
- the treating chamber comprises the rotatable drum;

the one more one or more items comprise one or more pieces of laundry;

the treating cycle is a washing cycle for washing the one or more pieces of laundry loaded in the drum;

the logic unit is configured to control the electric and/or electronic components of the washing machine so as to make the latter to perform a washing cycle;

the load amount acquiring device is adapted for acquiring the weight of the laundry loaded into drum;

the one or more additives comprise one or more washing/rinsing products.

In a further aspect thereof, the present invention is related to a method for operating a water bearing household appliance, wherein the water bearing household appliance comprises:

a treating chamber in which one or more items can be loaded and treated with water and one or more additives;

a logic unit to control the electric and/or electronic components of the appliance so as to make the latter to perform a treating cycle for treating the one or more loaded items with water and one or more additives;

a load amount acquiring device for acquiring and communicating to the logic unit information related to the amount of the one or more items loaded in the treating chamber;

a user interface configured for allowing a user to set parameters related to the treating cycle and to the one or more additives to be used during the treating cycle.

The method comprises the steps of:

storing by the logic unit, during a programming state, additive information set by the user via the user interface; the additive information comprising one or more numeric values which are indicative of predetermined maximum amount of additive associated with the maximum loading capacity of the treating chamber;

and before the water bearing household appliance starts a selected treating cycle, performing the following phases:

acquiring the amount of the loaded one or more items by the load amount acquiring device, determining the amount of additive to be loaded for this treating cycle, based on the programmed maximum amount of additive associated with a selected additive, the acquired amount of loaded one or more items, and the selected treating cycle, providing to the user, via the user interface, information related to the determined amount of additive to be loaded.

Preferably, in the water bearing household appliance in which the inventive method is performed, the load amount acquiring device is configured for detecting the amount of the one or more items loaded in the treating chamber and/or is configured for allowing a user to set a parameter related to the amount of the one or more items loaded in the treating chamber.

Advantageously the inventive method comprises the step of displaying, via the user interface, a numeric value in grams or milliliters, indicative of the determined dosing amount of additive.

Preferably, the inventive method comprises the step of selecting/setting, during the programming state, the additive to be programmed, and regulating the numeric value associated with the predetermined maximum amount of the selected/set additive associated with the maximum load-capacity of the treating chamber.

Advantageously, in the inventive method the programming state is performed when the water bearing household appliance is in a rest operating state.

Preferably, in the inventive method the following phases are performed during the loading of the one or more items into the treating chamber:

acquiring the amount of the loaded one or more items by the load amount acquiring device, determining the amount of additive to be loaded for the selected treating cycle, based on the programmed maximum amount of additive associated with a selected additive, the acquired amount of loaded one or more items, and the selected treating cycle, providing to the user, via the user interface, information related to the determined amount of additive to be loaded.

Preferably, in the method according to the invention, the predetermined maximum amount of additive is associated with a numeric value recommended by the additive producer.

Advantageously, the additive used in the inventive method comprises a liquid detergent, and/or a concentrate detergent, and/or a gel detergent and/or a tablet detergent, and/or powder detergent, and/or a softener.

In a preferred embodiment, the inventive method is applyed to a water bearing household appliance being a laundry washing machine comprising a washing tub a rotatable drum adapted for receiving laundry to be washed; in this advantageous embodiment:

the treating chamber comprises the rotatable drum;

the one or more items comprise one or more pieces of laundry;

the treating cycle is a washing cycle for washing the one or more pieces of laundry loaded in the drum;

the logic unit is configured to control the electric and/or electronic components of the washing machine so as to make the latter to perform a washing cycle;

the load amount acquiring device is adapted for acquiring the weight of the laundry loaded into drum;

the one or more additives comprise one or more washing/rinsing products.

BRIEF DESCRIPTION OF THE DRAWINGS

Features and advantages of embodiments the present invention will anyway be more readily understood from the description that is given below by way of non-limiting example with reference to the accompanying drawings, in which.

DETAILED DESCRIPTION OF EXAMPLE EMBODIMENTS

The following description refers to an advantageous embodiment of the invention in which the water bearing household appliance is a laundry washing machine 1.

However it is clear that the invention can be applied as well to other water bearing household appliances, for example a dishwasher, not illustrated.

The washing machine 1 according to the invention which is schematically illustrated in the enclosed Figures is advantageously of the front-loading type; it is however clear that the invention is applicable, substantially without any crucial modification, to a top-loading washing machine.

It is also clear that the invention can be applied, substantially without any modification, both to a "simple" washing machine (i.e. a washing machine which can only wash and rinse the laundry) and to a washing-drying machine (i.e. a washing machine which can also dry the laundry).

Figure 3:
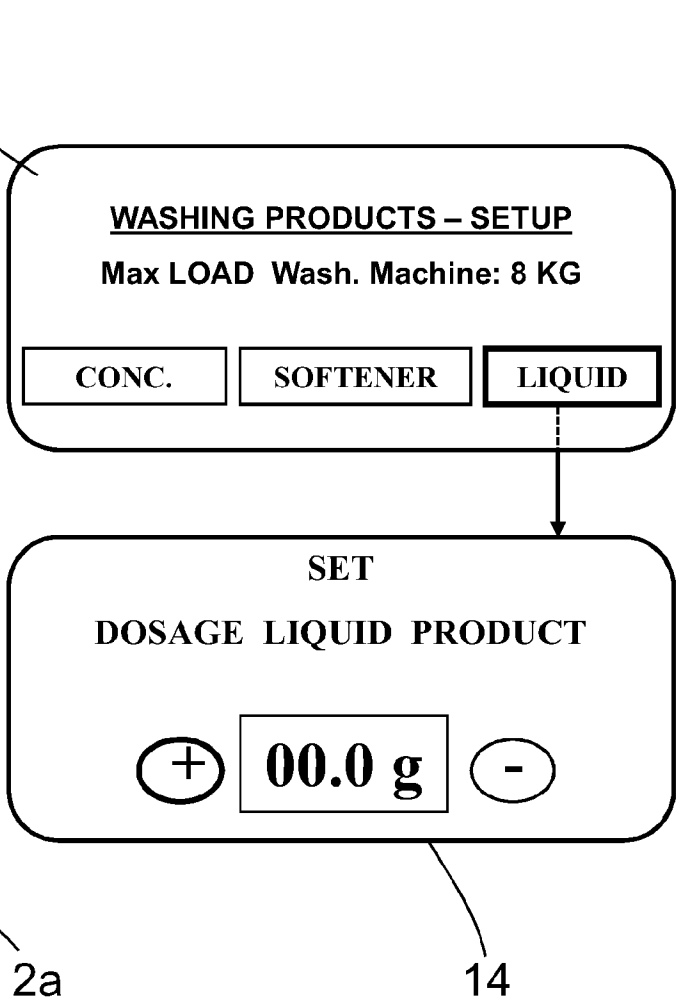
FIG. 3 is enlarged schematic view of the user interface of the water bearing household appliance illustrated in FIG. 2, during two consequential phases of the programming state wherein the maximum loading-amount of a first type of additive is set.
Figure 4:
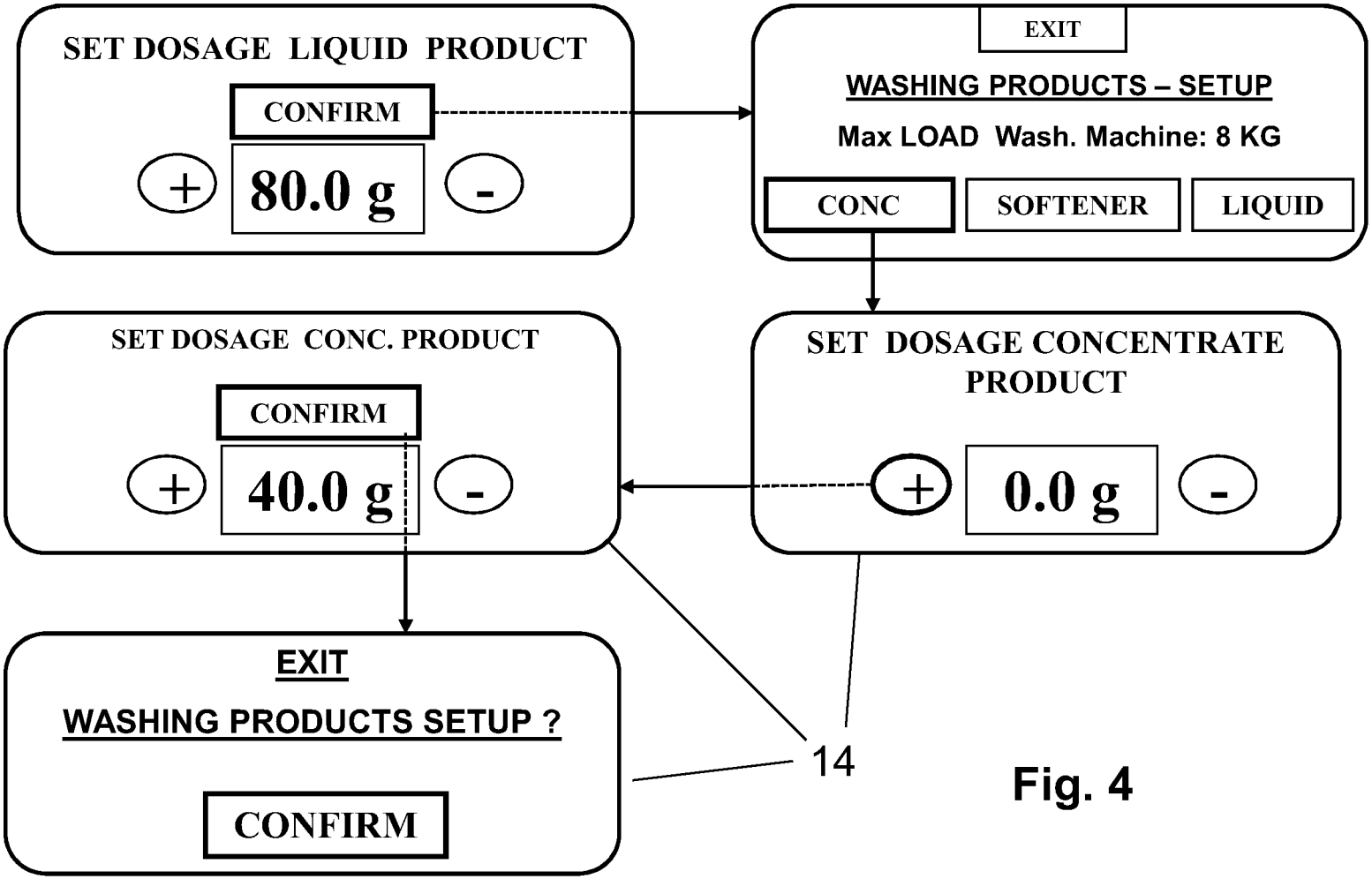
FIG. 4 comprises sequential enlarged schematic views of the user interface of the water bearing household appliance illustrated in FIG. 2 during relative programming steps of the maximum loading-amounts of a first and second type of additive.
Figure 6:
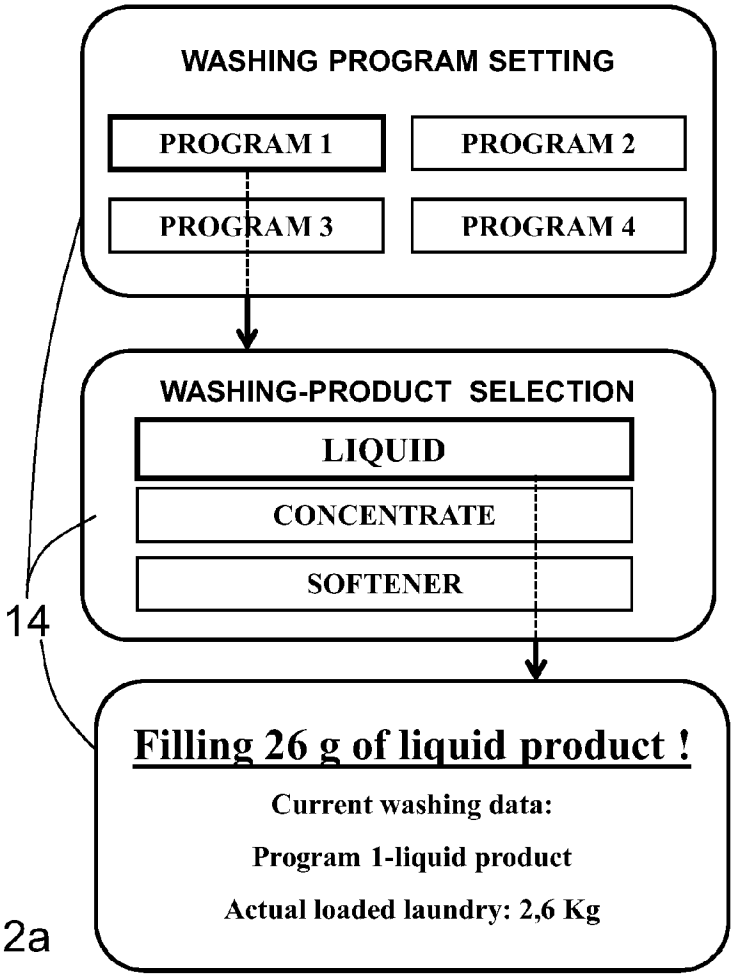
FIG. 6 comprises three sequential enlarged schematic views of the user interface of the inventive water bearing household appliance, during the setting of treating cycle (washing cycle in this advantageous illustrated embodiment) and additive (washing product in this advantageous illustrated embodiment), and the displaying of a recommended additive dosage.
Figure 5:
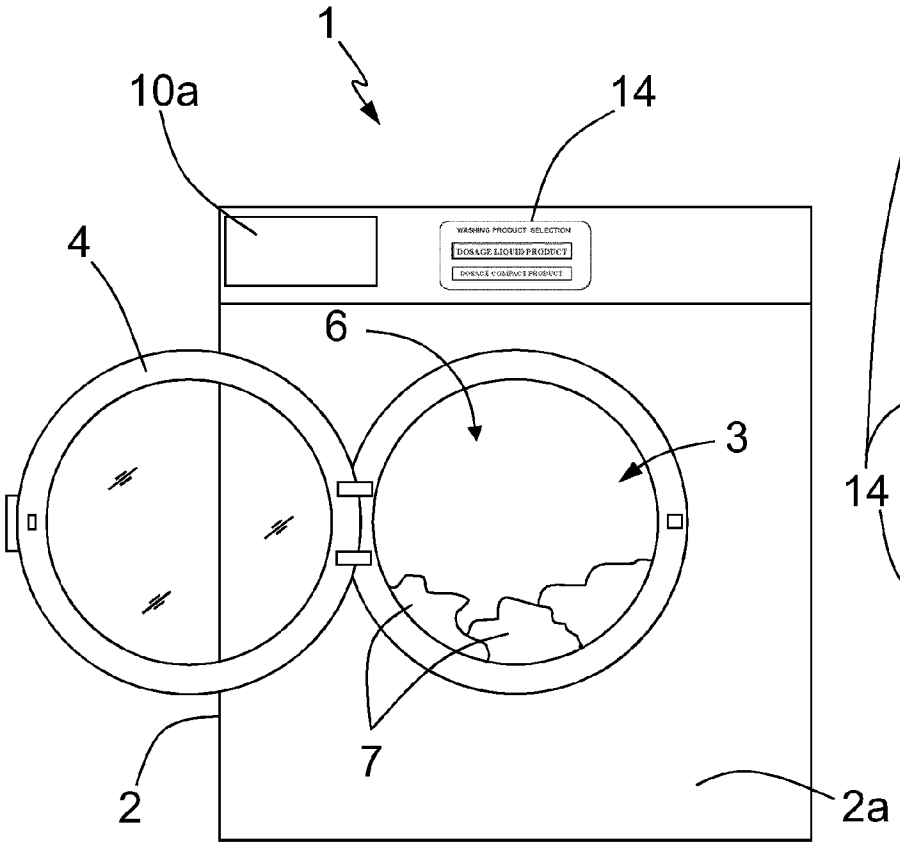
FIG. 5 is a schematic frontal view of the water bearing household appliance of FIG. 2, during the loading of the items to be treated (laundry in the advantageous illustrated embodiment) and the setting of the treatment cycle (a washing cycle in this advantageous illustrated embodiment)
Figure 7:
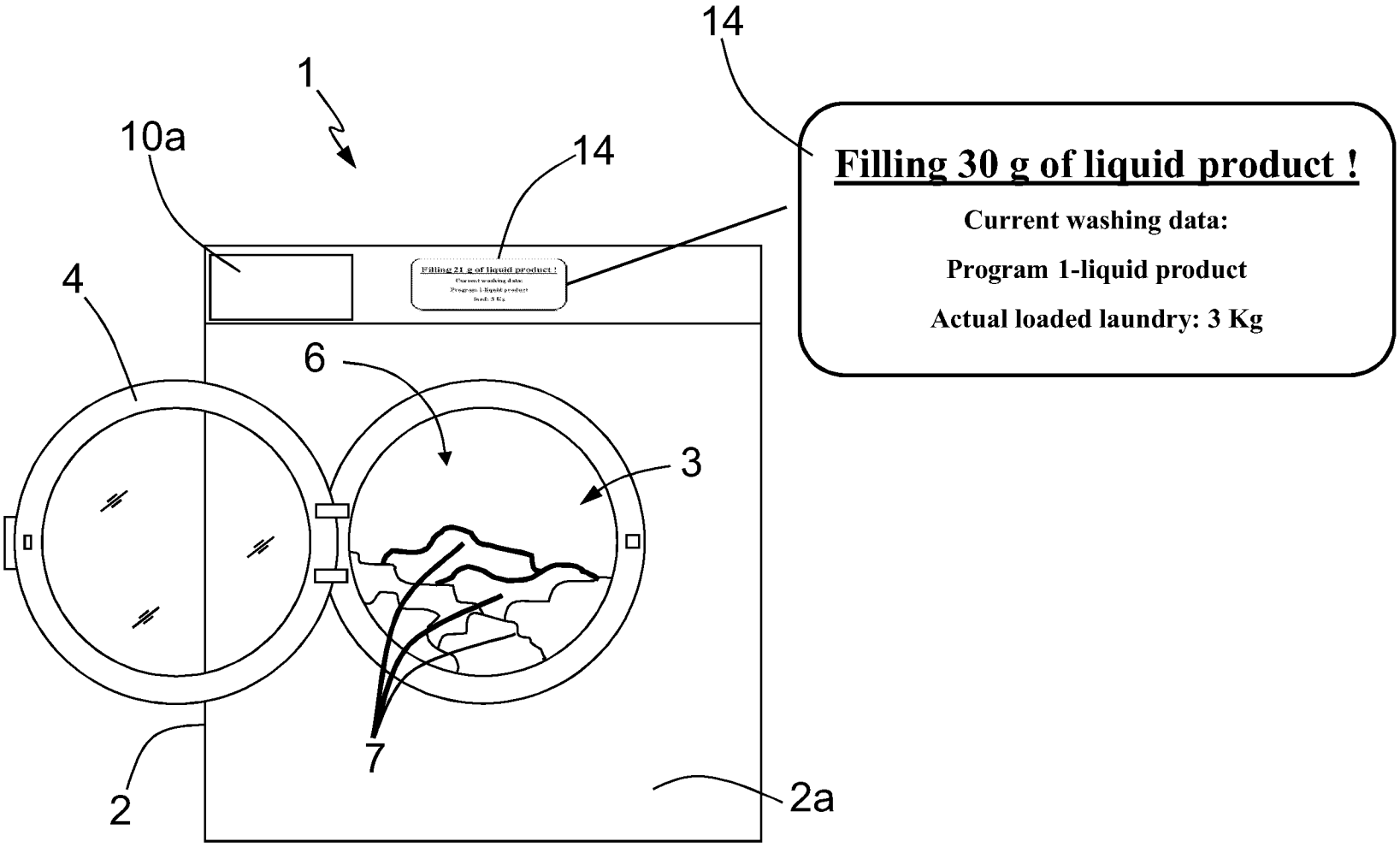
FIG. 7 is a schematic frontal view of the water bearing household appliance of FIG. 2, with the user interface enlarged for clarity, displaying of the amount of additive to be filled, after a changing of amount (weight in this advantageous illustrated embodiment) of the loaded items (laundry in this advantageous illustrated embodiment)

With reference to FIGS. 1 to 7, the washing machine 1 comprises an external casing 2 in which frontal wall 2*a* (the frontal wall 2*a* has not been represented in FIG. 1) an access opening 3 is obtained, provided with a loading/unloading door 4, which allows the access to a washing tub 5 contained in the external casing 2; the washing tub 5 contains a rotatable perforated drum 6 in which the laundry to be washed, numbered 7 in FIGS. 5 and 7, can be loaded and unloaded. In this advantageous embodiment the drum 6 embodies, therefore, a treating chamber in which one or more items (pieces of laundry 7 in this advantageous embodiment) can be loaded and treated with water and one or more additives (washing/rinsing products in this advantageous embodiment)

The washing tub 5 is connected to the external casing 2 preferably via a flexible bellows, not represented, connected between the frontal, opened, surface of the washing tub 5 facing the access opening 3, and the border of the latter.

Figure 1:
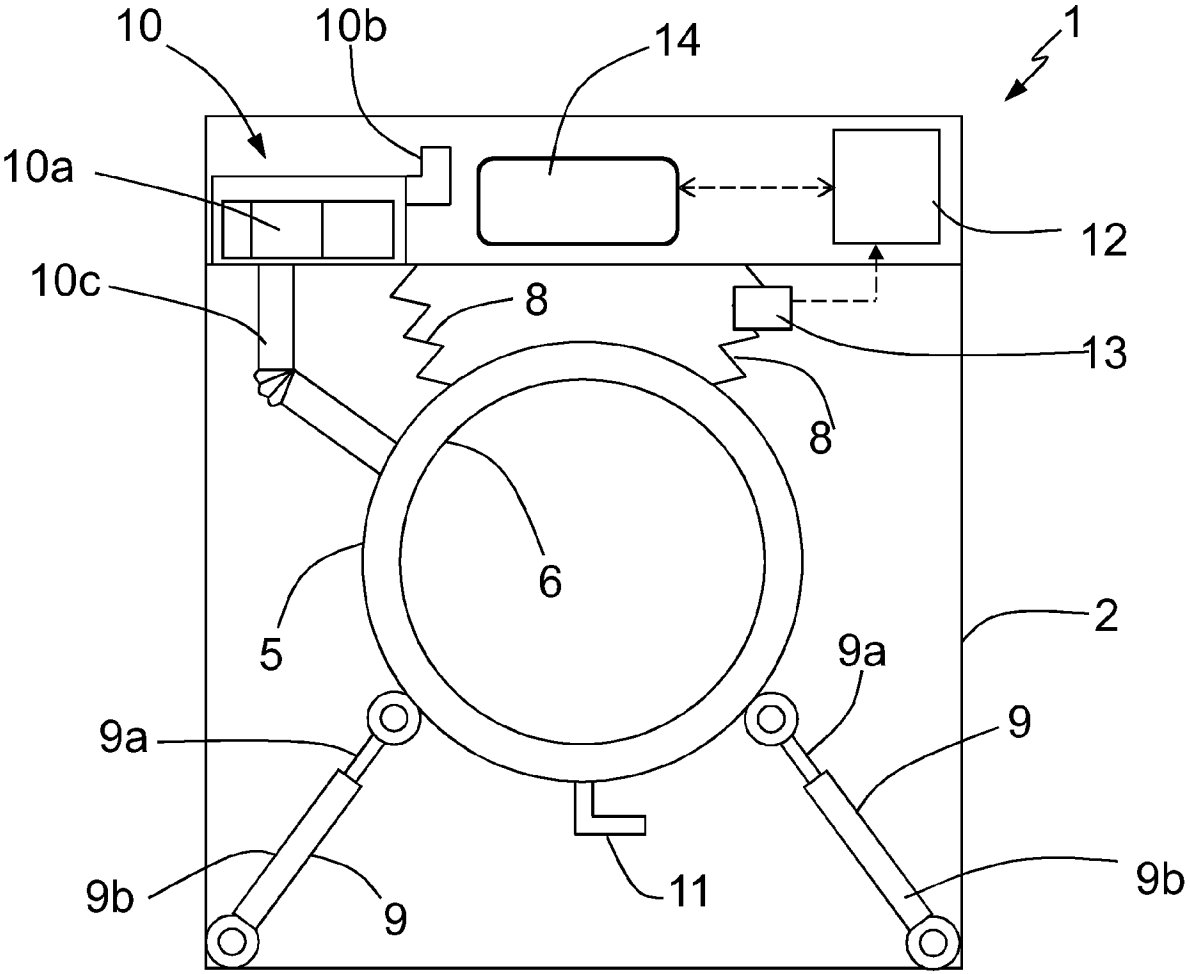
FIG. 1 is a schematic frontal view, with part removed from clarity, of a water bearing household appliance (a laundry washing machine in the advantageous illustrated embodiment), according to the invention.

In the example illustrated in FIG. 1, the washing tub 5 is advantageously elastically supported by the external casing 2 via a suitable resilient support system, comprising, for example, two or more springs 8; preferably the oscillations of the washing tub 5 are damped by suitable shock-absorbing devices or dampers 9, interposed between the washing tub 5 and the bottom of the casing 2.

Clearly the washing tub 5 may be associated to the casing 2 in any other suitable way.

Advantageously the washing machine 1 comprises a water inlet circuit 10, only partially illustrated in FIG. 1, adapted for feeding water and washing/rinsing products, into the washing tub 5; the water inlet circuit 10 comprises, for example a removable drawer 10*a*, adapted to be filled with washing and/or rinsing products, e.g. liquid or concentrate or gel detergent, or powder detergent, or softener, an inlet duct 10*b*, only partially represented in FIG. 1, connectable to water delivery means present outside the washing machine 1 and adapted to deliver fresh water to the drawer 10*a*, and an outlet duct 10*c*, fluidly connecting the drawer 10*a* and the washing tub 5 and adapted to deliver water and washing/rinsing products into the washing tub 5.

The washing machine 1 also advantageously comprise a draining circuit 11, only partially represented in FIG. 1, fluidly connected to the bottom of the washing tub 5 and adapted to drain the washing/rinsing liquid from the washing tub 5; in a further embodiment, not illustrated, the draining circuit 11 may be also provided with a recirculation circuit, adapted to drain the washing/rinsing liquid from the bottom of the washing tub 5, and to re-admit such liquid into an upper region of the washing tub 5, for improving the wetting of the laundry.

The washing machine 1 also comprises some electric and/or electronic components, not illustrated, adapted for performing some specific functions; for example the washing machine may comprise an electric motor for rotating the rotatable drum 6, an electric pump adapted to deliver the washing/rinsing liquid into the washing tub 5, an electric pump adapted to drain and/or to re-circulate the washing/rinsing liquid from the washing tub 5, an electric heater adapted to heat the washing/rinsing liquid, etc.

The washing machine 1 advantageously comprises a logic unit (for example an electronic board, a microcontroller, a microprocessor, or any other similar electronic control unit/device), schematically indicated in FIG. 1 with the block numbered 12, configured to control the electric and/or electronic components of the washing machine 1, so as to make the washing machine 1 to perform a treating cycle, in this advantageous embodiment a washing cycle, advantageously comprising one or more phases; for example the washing cycle may comprise a prewash phase, a soaking phase, a main wash phase (comprising, for example, the adduction into the washing tub 5 of water mixed with detergent and the rotation of the drum 6, so as to apply a mechanical action on the laundry), a steam supplying phase, a rinsing phase, a spinning phase, etc. The washing cycle may comprise one or more of the above mentioned phases (or also other phases well known in the art) adapted to apply to the laundry to be washed a specific chemical and/or physical action. A phase of the washing cycle may be performed, during a single washing cycle, only once or also two or more times. Clearly the duration of the overall washing cycle depends on the kind, on the number, and on the duration of its phases.

The washing machine 1 is also provided with a load amount acquiring device which, in a preferred embodiment, may comprise a weighing device, schematically represented in FIG. 1 with the block numbered 13, which is configured to detect/measure the weight of the laundry 7 loaded in the rotatable drum 6. For example the weighing device 13 may comprise one or more transducers, operatively connected to the logic unit 12; the transducers may comprise, for example, a load cell or a strain gauge and can be associated with the resilient support system 8 supporting the washing tub 5.

In a further embodiment not illustrated, one or more transducers of the weighing device 13 may be associated with the support of the washing machine 1 (for example to one or more support feet, not represented, adapted to support the casing 2 of the washing machine 1), so as to detect the overall weight of the washing machine 1 (in this last case the weight sensed by the one or more transducers increases when the laundry is loaded into the rotatable drum 6).

In a further embodiment thereof, the weighing device 13 may comprise one or more transducers, not illustrated, configured to sense a variation of the length of the shock-absorbing devices or dampers 9, and to communicate this information to the logic unit 12, which is configured to associate this length variation to a variation of the weight of the washing tub 5, and therefore to the weight of the laundry 7 loaded into the rotatable drum 6. For example, one or more of the dampers 9 interposed between the washing tub 5 and the bottom of the casing 2 may comprise a piston 9*a* movable in a cylindrical housing 9*b*, and a device, not illustrated, adapted to measure the position of the piston 9*a* inside the housing 9*b*; this device may comprise a coil unit wound around the housing 9*b* of the damper 9 and a sensor element located at the end of the piston 9*a*, which is located inside the cylindrical housing 9*b*. The sensor element may be made of metal, e.g. iron. The coil unit is connected by wire to an evaluating unit of the washing machine 1, operatively connected to the logic unit 12 (the evaluating unit may be for example comprised in the logic unit 12). When the piston 9*a*, and therefore the sensor element, moves, e.g. due to loading the washing machine 1 with laundry 7, the sensor element changes the inductivity of the coil unit. As the change of inductivity is proportional to the penetration depth of the piston 9*a* into the coil unit, the travel path length of the piston 9*a* can be determined by the evaluating unit. The logic unit 12 may be in this case configured to calculate the weight of the laundry loaded into the rotatable drum 6 as a function of the measured travel path length of the piston 9*a*.

However it is underlined that the use of a particular weighing device 13 is not critical for the invention, and therefore substantially any device adapted to measure the weight of the laundry 7 loaded into the rotatable drum 6 may be used.

In a further advantageous embodiment, the load amount acquiring device may be configured for allowing a user to set a parameter (for example the weight) related to the amount of the one or more items (the laundry 7 in this advantageous embodiment) loaded in the treating chamber (the drum 6 in this advantageous embodiment). In this case the load amount acquiring device may advantageously comprise an input device, for example a selector, a switch, a button, a region of a touch screen, etc., arranged in such a way to allow the user to communicate to the logic unit 12 information related to the amount of loaded item, for example the weight of the loaded laundry (which may be estimated by the user, or measured for example by a weighing device external to the washing machine), or the fact that the washing cycle has to be performed for an amount of laundry which is half of the maximum allowed load (so called "half-load" cycle or program).

The washing machine 1 comprises an user interface 14, which is operatively connected to the logic unit 12 and is configured to allow the user to manually set a washing cycle to be performed, and to select a type of additive (in this case a washing-product, i.e. a detergent, a softener, or any other similar washing-product), to be used during the washing cycle.

User interface 14 may comprise, for example, a touch screen display, adapted to display information and to receive inputs from the user, and or it may comprise a one or more buttons, and/or switches, and/or knobs, and/or displays, etc. allowing the user to receive information and to input instructions/commands directed to the logic unit 12, Advantageously, the user interface 14 is further configured to allow the user to program during a programming state, "additive (washing-product in this embodiment) information", which are indicative of the maximum quantity/amount of additive (washing-product in this embodiment) that is suitable (preferably recommended by the additive producer) for the loading-capacity of the drum 6 of the washing machine 1.

In other terms the user, by means of the user interface 14, may program the washing machine 1 with one or more number values which are indicative of the maximum quantity/amount of a specific washing-products which is recommended (preferably this recommended maximum quantity has been determined by the additive producer) for a maximum weight of laundry loadable into the rotatable drum 6 of the washing machine 1.

User interface 14 may be further configured to display user information; this information may comprise the name of a particular washing cycle, the weight of the loaded laundry, the duration of the washing cycle, the temperature of the washing/rinsing liquid, the rotating speed of the spinning, etc. More in general the user interface 14 is designed to present information related to the washing cycle and/or the status of the washing machine 1.

According to an aspect of the present invention, the user interface 14 is further configured to provide/suggest the right dosage/amount of washing-product that user should fill/load into the drawer 10*a* before the washing machine 1 starts performing the selected washing cycle to wash a certain amount (weight) of loaded item (laundry). User interface 14 is configured to display information related to the dosage/amount of washing-product which the user should manually fill/load into the removable drawer 10*a* after the washing cycle and washing product have been selected, but before starting the washing cycle.

In the embodiment illustrated in the enclosed Figures, the user interface 14 advantageously comprises a display device, preferably a LCD or a LED display, designed to present user information, and a separated input device, not illustrated, comprising for example a keyboard, and/or a set of keys or knobs, and/or one or more touch-sensitive input devices, etc., adapted for setting a washing cycle and washing-product information.

In another embodiment, not illustrated, the user interface 14 may comprise a touch-sensitive display adapted both for presenting user information, and for allowing a user, by touching some specific regions of this touch-screen display, to set a washing cycle and additive (washing-product) information.

In another embodiment, not illustrated, the logic unit 12 may be advantageously integrated in the user interface 14.

It is underlined that in the present application the expression "to program the additive (washing-products in the illustrated advantageous embodiment) information" is intended as:

selecting one or more type of additives (washing-products in the illustrated advantageous embodiment), e.g. detergents, comprised in a additive-type (e.g. powder, liquid, gel, tablets, etc.) list stored in the memory of the logic unit 12 (if this list is provided) or manually inputted by the user via the user interface 14, programming, for a selected additive, the maximum amount of additive associated with the maximum loading capacity of the water bearing appliance 1 (e.g., in a washing machine 1, programming the maximum laundry weight loadable in the rotatable drum 6.

For example, the user may select/set, via the user interface 14, a washing-product corresponding to a "concentrate detergent", a "liquid detergent", a "powder detergent", a "gel detergent", a "tablet detergent", a "softener detergent" or any other detergent suitable for a washing cycle presents in a stored additive-type list (or the user may add manually a new type of additive, optionally to be added to the stored additive-type list, if this is provided, via the user interface 14), and he may set the maximum amount of additive calculated by additive-producer, on the basis of the laundry loading capacity of the drum 6.

For example, user may obtain/read additive information to be programmed, in the packaging of a additive (e.g. washing-products), which typically contains information concerning the suggested dosage of the additive, and programming maximum amount of additive based on the read additive information.

After the user has programmed the maximum amount of additive, and before the washing machine 1 starts a selected washing cycle, the logic unit 12 preferably acquires the weight of loaded laundry 7 (or the user manually input an information related to the weight of the loaded laundry, e.g. he may set the "half-load" cycle) and the kind of washing-product selected by the user (which information may be provided by the user by interface 14), and computes the right amount of additive (e.g. washing-product) to be filled in the appliance 1 (e.g. in the drawer 10*a*) on the basis of the stored maximum amount of additive associated with the selected type of additive, the weight of the loaded laundry, and the selected washing cycle.

Figure 2:
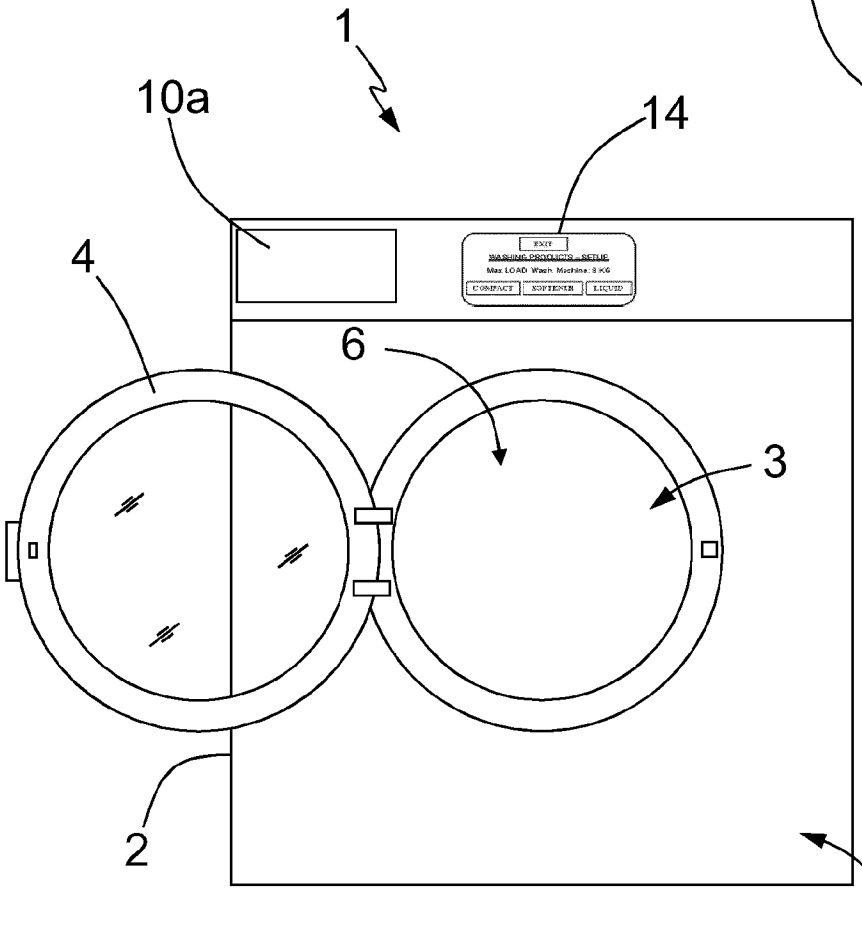
FIG. 2 is a schematic frontal view of the water bearing household appliance of FIG. 1 during a programming state of the maximum amount of additive (a washing-product in the advantageous illustrated embodiment)

For example, FIGS. 2, 3, and 4 illustrate a washing machine 1 and the user interface 14 during a programming state in which user programs the washing-products (additive) information, i.e. the maximum amount of washing-products (additive) associated with the loading capacity of drum 6, whereas FIGS. 5, 6 and 7 illustrate the condition in which the user is setting the washing cycle and loading the laundry 7 into the rotatable drum 6, and, preferably at the same time, the user interface 14 displays the computed dosage/amount of washing-product (additive) to be used.

With reference to FIGS. 2 and 3 showing an example of the programming state, the user selects a washing-product to be programmed (a detergent/softener), by means of the user interface 14 (for example by pressing an icon showing the word "LIQUID" in a touch-screen display advantageously comprised in the user interface 14); after selection, the user interface 14 displays a setting windows providing a message inviting the user to set the recommended value/amount of the selected detergent to be associated with the maximum loading capacity of the drum 6. For example, the value of the maximum amount of detergent may be regulated and displayed via the user interface 14 in grams (as in FIG. 3), or milliliters, or number of tablets, depending on the type of washing-product that user has selected. It is evident that in case of liquid or gel detergent or liquid or gel softener the maximum amount is preferably regulated/displayed in milliliters, whereas for powder detergent the maximum amount is preferably regulated/displayed in grams. For example, user may regulate a numeric value indicating the washing product amount by pressing control buttons/icons present in the user interface 14 and commands the storage of the selected numeric value by pressing one or more confirm buttons/icons.

In the advantageous example shown in FIG. 4, during the programming state of the additive (washing product) information, a user interface programming window displays a selected detergent and a numeric value of the maximum amount of detergent which user has setup; for example, in FIG. 4 user interface 14 displays that the selected washing-product is a liquid detergent, and the numeric value indicative of the maximum amount of the liquid detergent programmed by the user (e.g. according to indication of detergent producer) is 80 grams for a loading capacity of about 8 Kg; after fixing the maximum amount of liquid detergent, the user interface 14 invites user to confirm the fixed/programmed numeric value.

After having ended the programming of maximum amount of a certain type of washing-product, user may repeat, via user interface 14, the above operations for one or more further kinds of washing-products. For example, in FIG. 4, after having completed the programming of the maximum amount associated with a liquid detergent, user starts setting a washing product corresponding to a concentrated detergent, and regulates the numeric value indicatives of the maximum amount of the concentrated detergent recommended from a detergent producer in order to fix it at 40 g corresponding to the loading capacity of the drum 6 of 8 Kg; after programming the maximum amount of the concentrate detergent, the user interface 14 invites user to confirm the maximum dosage assigned to the concentrated detergent.

In a further embodiment, not illustrated, logic unit 12 is configured for allowing the user to add (for example by the user interface 14) to the list of detergent-type shown for example in FIG. 3 (in this case the list comprises three types of additives, that is CONCENTRATE, LIQUID, SOFTENER), further types of additives which may be set/programmed (for example a POWDER detergent, a GEL detergent, etc.).

In the example shown in FIGS. 5, 6 and 7 the user is loading the laundry 7 in the drum 6 and is setting the washing cycle and washing-product before starting the washing cycle; preferably during the loading of the laundry 7 (but in a further advantageous embodiment this step can be also performed after the loading, i.e. when the loading procedure has already ended, which may be communicated to the logic unit 12 for example by a suitable switch connected to the open/close status of the door 4), the setting window of the user interface 14 advantageously suggests/displays to the user the calculated dosage of liquid detergent to be filled into the drawer 10*a*. For example, in FIG. 6, user has set liquid detergent and washing cycle number 1; the logic unit 12 advantageously calculates the right dosage of liquid detergent based on the measured weight of the loaded laundry 7 the stored maximum amount associated with the liquid detergent and the selected treating cycle; the user interface 14 displays the calculated dosage of liquid detergent to be suggested to the user.

In a further advantageous embodiment, information related to the load amount is inputted by the user for example by the user interface 14; in this case the logic unit 12 calculates the right dosage of liquid detergent based on the inputted information related to the amount (e.g. weight) of the loaded laundry 7, the stored maximum amount associated with the additive, and the selected washing cycle;

and the user interface 14 displays the calculated dosage of liquid detergent to be suggested to the user.

Figure 8:
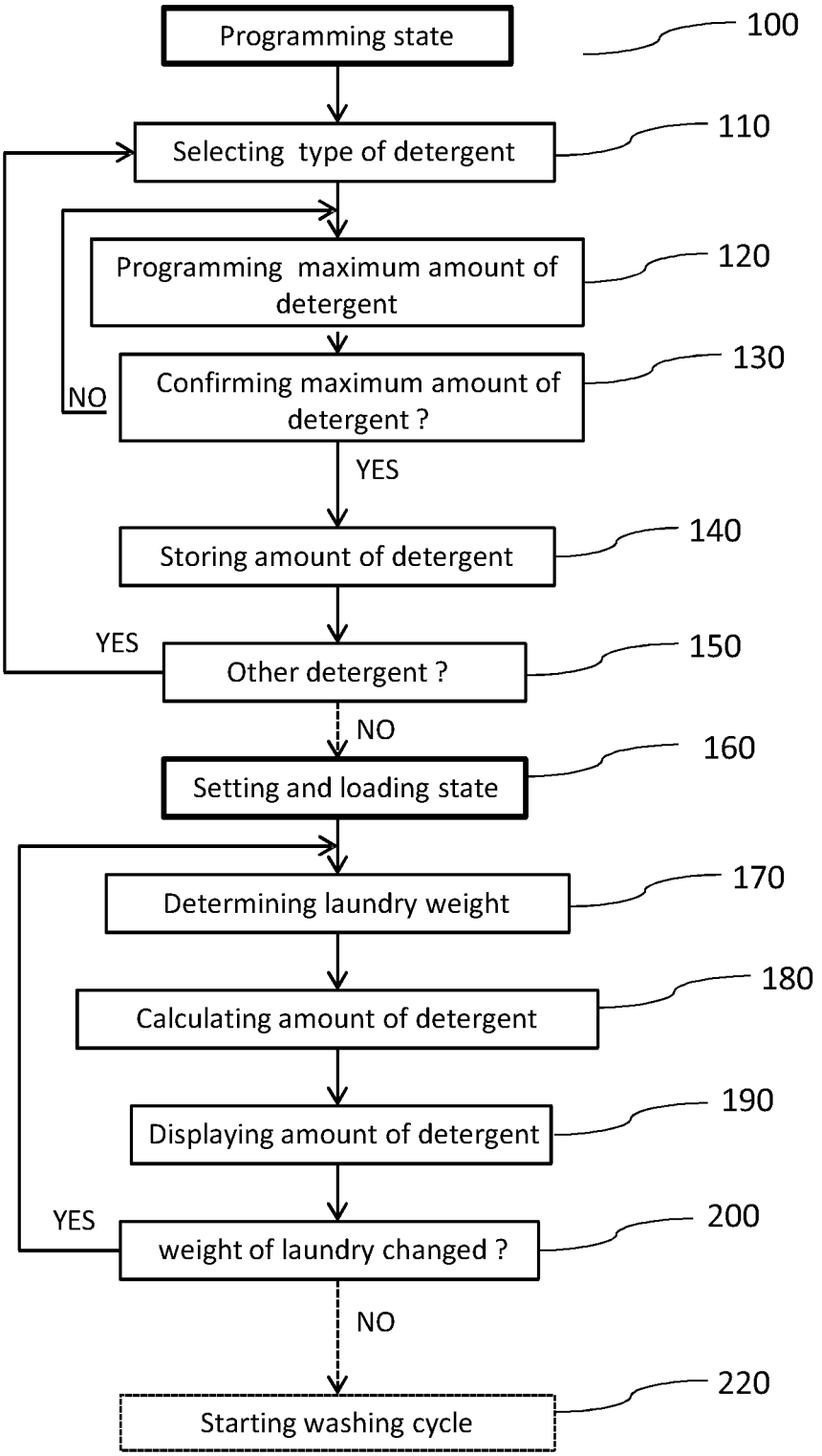
FIG. 8 is a flow chart of the steps of an advantageous embodiment of the operating method performed according to an aspect of the present invention.

With reference to FIG. 8, a preferred embodiment of the inventive method for operating the water bearing appliance (e.g. washing machine 1) made according to the principles of the present invention shall now be described, advantageously with particular reference to a washing machine 1.

It is however clear that the same method may be applied without any crucial modification to other water bearing household appliances, for example to a dishwasher.

In the initial phase, the programming state of additive (washing-products in this embodiment) information is started (block 100). Programming state may be performed when the water bearing household appliance (washing machine 1 in this embodiment) is in a rest condition.

The user selects a type of additive (washing-product), i.e. a detergent (block 110) (user-interface shown in FIG. 3).

According to a preferred embodiment, user interface 14 may be configured to display a plurality of type of additives (detergents) selectable by the user. In a different embodiment, user interface 14 may be configured in such a way that user may directly input the type of detergent he wants to program/set.

After user has selected (or inputted) a type of additive, user interface 14 advantageously displays the programming window to allow the user to regulate/set the numeric value which is associated with the maximum quantity/amount of the selected additive (washing-product) according to recommendation/indications provided by the additive (washing-product) producer (block 120) (FIG. 3).

After user has set the maximum amount of additive (washing-product), preferably user interface 14 advantageously invites the user to confirm the programmed/fixed maximum amount of additive (washing-product) (block 130) (FIG. 4).

In negative case (NO output from block 130), preferably the method performs the previous phase (block 120), whereas in positive case (YES exit from block 130), preferably the logic unit 12 stores in a memory the programmed/fixed quantity/amount associated with the type of selected additive (washing-product) (block 140).

The logic unit 12 advantageously checks whether a further type of additive (washing-product) has been selected/set by the user (block 150), and in positive case (YES output from block 150) the operative phases discloses in the blocks 110-140 are advantageously repeated for the further type of additive (washing-product) (FIG. 4), whereas in negative case (NO output from block 150), the programming state of additive (washing-product) information is advantageously ended.

Once the setup of additive (e.g. washing-product) information has been concluded, the user may use the water bearing household appliance (e.g. washing machine 1) to treat (e.g. wash) the one or more loaded items (laundry in the embodiment of a laundry washing machine, but these may be dishes in case of a dishwasher) by obtaining, after the setting of the washing cycle and before the water bearing household appliance (e.g. washing machine 1) starts the washing cycle, preferably during the loading of the items (e.g. laundry 7), an indication about the correct dosage of additive (e.g. washing-product) which should be filled/loaded (in the illustrated embodiment in the drawer 10*a*) for the actual amount of loaded items (e.g. actual weight of loaded laundry 7).

With reference to FIGS. 6 and 7, user selects a treating cycle (e.g. washing cycle named "PROGRAM 1") and the type of additive (e.g. detergent named "LIQUID") to be used, and loads the item/s (e.g. laundry 7) into the treating chamber (e.g. rotatable drum 6) (block 160). The logic unit 12 determines, preferably during the loading of the items (but it is possible that this phase is performed only at the end of the loading phase, which end may be communicated to the logic unit 12 for example by a suitable switch connected to the open/close status of the door 4), the weight of the items (e.g. laundry 7) loaded in the treating chamber (e.g. drum 6) based on data provided by the load amount acquiring device (e.g. weighing device 13) (block 170), and calculates the dosage/amount of the additive (e.g. washing-product) to be recommended to the user on the basis of the stored maximum amount of additive (e.g. washing-product) associated with the selected additive, the selected treating cycle (e.g. washing cycle named "PROGRAM 1" in FIG. 6), and the acquired amount of the loaded item/s (e.g. determined or inputted weight of the laundry) (block 180).

In a further advantageous embodiment, information related to the load amount may be inputted by the user for example by the user interface 14; in this case the logic unit 12 calculates the right dosage of additive (e.g. liquid detergent) based on the inputted information related to the amount (e.g. weight) of the item/s (e.g. loaded laundry 7), the stored maximum amount associated with the selected additive, and the selected treating cycle (e.g. washing cycle).

The logic unit 12 advantageously controls the user interface 14 to display the calculated dosage of additive (washing-product) (block 190), and preferably checks weather the load amount (e.g. weight of the laundry loaded into the drum 6 by the user) is changing (block 200). Preferably, if load amount is changing (YES output from block 200), the logic unit 12 performs operative phases disclosed in blocks 170-200. Preferably, if load amount is not changing (NO output from block 200) the user interface 14 maintains the display of the last calculated additive amount to be loaded.

In a preferred embodiment, displaying by user interface 14 of the additive amount to be filled/loaded may be ended when the door 4 of the appliance is closed, after items loading and/or immediately before the water bearing appliance tarts performing the treating cycle.

In a further advantageous embodiment, displaying by user interface 14 of the additive amount to be filled/loaded may be performed only after the loading of the items/s is ended, which information may be communicated to the logic unit 12 for example by a suitable switch connected to the open/close status of the door 4 of the water bearing appliance, and/or by a control device (e.g. a switch or a selectable icon in a touch screen, etc.) which may be operated by a user.

It is clear that the step of storing, during a programming state, additive information comprising one or more numeric values which are indicative of predetermined maximum amount of additive associated with the maximum loading capacity of said treating chamber may be performed, does not need to be performed each time the water bearing appliance has to be used, since the logic unit 12, once additive information has been stores, advantageously keeps in its memory the stored additive information, so that they can be used for determine the amount of a selected additive to be loaded for any further treating cycle.

The water bearing appliance and the method of the present invention have the advantage to be able to inform user about the right dosage/amount of any kind of additive before water bearing household appliance starts a selected treating cycle, without any limitation on the kind of used additive, without requiring any additional complex and/or expensive devices such as, data network interfaces or read devices.

Clearly, changes may be made to the operating method and washing machine as described and illustrated herein without, however, departing from the scope of the present invention.

The invention claimed is:

1. A water bearing household appliance comprising:

a treating chamber in which one or more items can be loaded and treated with water and one or more additives;

a logic unit to control the electric and/or electronic components of said appliance so as to make the appliance perform a treating cycle for treating said one or more loaded items with water and said one or more additives;

a load amount detector device for detecting and communicating to said logic unit information related to the amount of the one or more items loaded in said treating chamber; and a user interface configured to allow a user to set parameters related to the treating cycle and to the one or more additives to be used during the treating cycle;

wherein said logic unit is configured to:

store, during a programming state, additive information set by the user via said user interface, said additive information comprising one or more numeric values which are indicative of a predetermined maximum amount of additive associated with the maximum loading capacity of said treating chamber, before the appliance starts a selected treating cycle, determine an amount of a selected additive to be loaded for said selected treating cycle, based on the programmed maximum amount of additive associated with the selected additive, on the detected amount of the one or more items loaded in said treating chamber, and on said selected treating cycle, and provide the user with said determined amount of additive to be loaded via said user interface.

2. A water bearing household appliance according to claim 1, wherein said predetermined maximum amount of additive, which user sets during said programming state, is associated with a numeric value recommended/calculated by the producer of the additive.

3. A water bearing household appliance according to claim 1, wherein said additive comprises a liquid detergent, and/or a concentrate detergent, and/or powder detergent, and/or a gel detergent and/or a tablet detergent and/or a softener.

4. A water bearing household appliance according to claim 1, wherein said logic unit is configured to display via said user interface a numeric value which is indicative of the determined amount of additive.

5. A water bearing household appliance according to claim 1, wherein the user interface is configured to allow the user, during the programming state, to select/set the additive to be programmed and to regulate said numeric value associated with said predetermined maximum amount of the selected/set additive associated with the maximum load-capacity of said treating chamber.

6. A water bearing household appliance according to claim 1, wherein said programming state is performed when the water bearing household appliance is in a rest operating state.

7. A water bearing household appliance according to claim 1, wherein said logic unit is configured to determine an amount of a selected additive to be loaded for a selected treating cycle, based on the programmed maximum amount of additive associated with the selected additive, on the detected amount of the one or more items loaded in said treating chamber, and on the selected treating cycle, and to provide the user with said determined amount of additive via said user interface, during the loading of said one or more items into said treating chamber.

8. A water bearing household appliance according to claim 1, wherein said load amount detecting device is configured to detect the amount of the one or more items loaded in said treating chamber and/or is configured for allowing a user to set a parameter related to the amount of the one or more items loaded in said treating chamber.

9. A water bearing household appliance according to claim 1, wherein:

said appliance is a laundry washing machine comprising a washing tub containing a rotatable drum adapted to receive laundry to be washed;

said treating chamber comprises said rotatable drum;

said one more one or more items comprise one or more pieces of laundry;

said treating cycle is a washing cycle for washing said one or more pieces of laundry loaded in said drum;

said logic unit is configured to control the electric and/or electronic components of said washing machine so as to make the washing machine perform a washing cycle;

said load amount detecting device is adapted for detecting the weight of the laundry loaded into drum; and said one or more additives comprise one or more washing/rinsing products.

10. A method for operating a water bearing household appliance, wherein the water bearing household appliance comprises:

a treating chamber in which one or more items can be loaded and treated with water and one or more additives;

a logic unit to control the electric and/or electronic components of said appliance so as to make the appliance perform a treating cycle for treating said one or more loaded items with water and said one or more additives;

a load amount detector device for detecting and communicating to said logic unit information related to the amount of the one or more items loaded in said treating chamber; and a user interface configured for allowing a user to set parameters related to the treating cycle and to the one or more additives to be used during the treating cycle; the method comprising the steps of:

storing by the logic unit, during a programming state, additive information set by the user via said user interface; said additive information comprising one or more numeric values which are indicative of predetermined maximum amount of additive associated with the maximum loading capacity of said treating chamber;

before the water bearing household appliance starts a selected treating cycle, performing the following phases:

detecting the amount of the loaded one or more items by the load amount detecting device, determining the amount of additive to be loaded for said selected treating cycle, based on the programmed maximum amount of additive associated with a selected additive, the detected amount of loaded one or more items, and the selected treating cycle, and providing to the user, via said user interface, said determined amount of additive to be loaded.

11. A method according to claim 10, wherein said load amount detecting device is configured to detect the amount of the one or more items loaded in said treating chamber and/or is configured for allowing a user to set a parameter related to the amount of the one or more items loaded in said treating chamber.

12. A method according to claim 10, comprising the step of displaying, via said user interface, a numeric value indicative of the determined amount of additive.

13. A method according to claim 10, comprising the step of selecting/setting, during the programming state, the additive to be programmed, and regulating said numeric value associated with said predetermined maximum amount of the selected/set additive associated with the maximum load-capacity of said treating chamber.

14. A method according to claim 10, wherein said programming state is performed when the water bearing household appliance is in a rest operating state.

15. A method according to claim 10, wherein the following phases are performed during the loading of the one or more items into said treating chamber:

detecting the amount of the loaded one or more items by the load amount detecting device, determining the amount of additive to be loaded for the selected treating cycle, based on the programmed maximum amount of additive associated with a selected additive, the detected amount of loaded one or more items, and the selected treating cycle, and providing to the user, via said user interface, said determined amount of additive to be loaded.

* * * * *